US005848909A

United States Patent [19]

Tsai

[11] Patent Number: 5,848,909

[45] Date of Patent: Dec. 15, 1998

[54] C-TYPE LAMP HOLDER

[76] Inventor: Chin Sung Tsai, No. 178, Chung Hsiao Rd., Hsinchu, Taiwan

[21] Appl. No.: 56,695

[22] Filed: Apr. 8, 1998

[51] Int. Cl.[6] ..... H01R 4/24

[52] U.S. Cl. ..... 439/206

[58] Field of Search ..... 439/419, 206, 439/602, 340, 414

[56] References Cited

U.S. PATENT DOCUMENTS 5,775,933 6/1998 Chen ..... 439/419

*Primary Examiner*—Neil Abrams
*Assistant Examiner*—Antoine Nganbjui
*Attorney, Agent, or Firm*—Rosenberg, Klein & Bilker

[57] ABSTRACT

This invention relates to a C-type lamp holder that includes an upper receiver with two holes for engaging with two conductive plates. The receiver is provided with troughs and slot for separating from the contact surface between the electrical wires, which are received within the receiver by a cap, and the receiver to receive water, if leaking in, and to prevent from a shortage of circuit. The conductive plates are provided with elastic contacting structures for elastic contact with the lamp to ensure the connection between the lamp and the lamp holder.

2 Claims, 4 Drawing Sheets

C-TYPE LAMP HOLDER

BACKGROUND OF THE INVENTION

A C-type lamp holder of a light string should have been designed with waterproof structure or draining structure. But the known lamp holders are usually without an important design to prevent the rain from leaking though contact surfaces between electrical wires and the lamp holder, that would occur a shortage of circuit if the rain contacts both conductive plates mounted in the lamp holder.

OBJECT OF THE INVENTION

The main object of the present invention is to provide an improved C-type lamp holder which includes two water troughs and a collecting slot to overcome the drawback of a prior one.

The detailed structure, features, and other advantages of this invention will become apparent from the following detailed description of a preferred embodiment when read with reference to the accompanying drawings.

DETAILED DESCRIPTION OF THE EMBODIMENT

Figure 1:
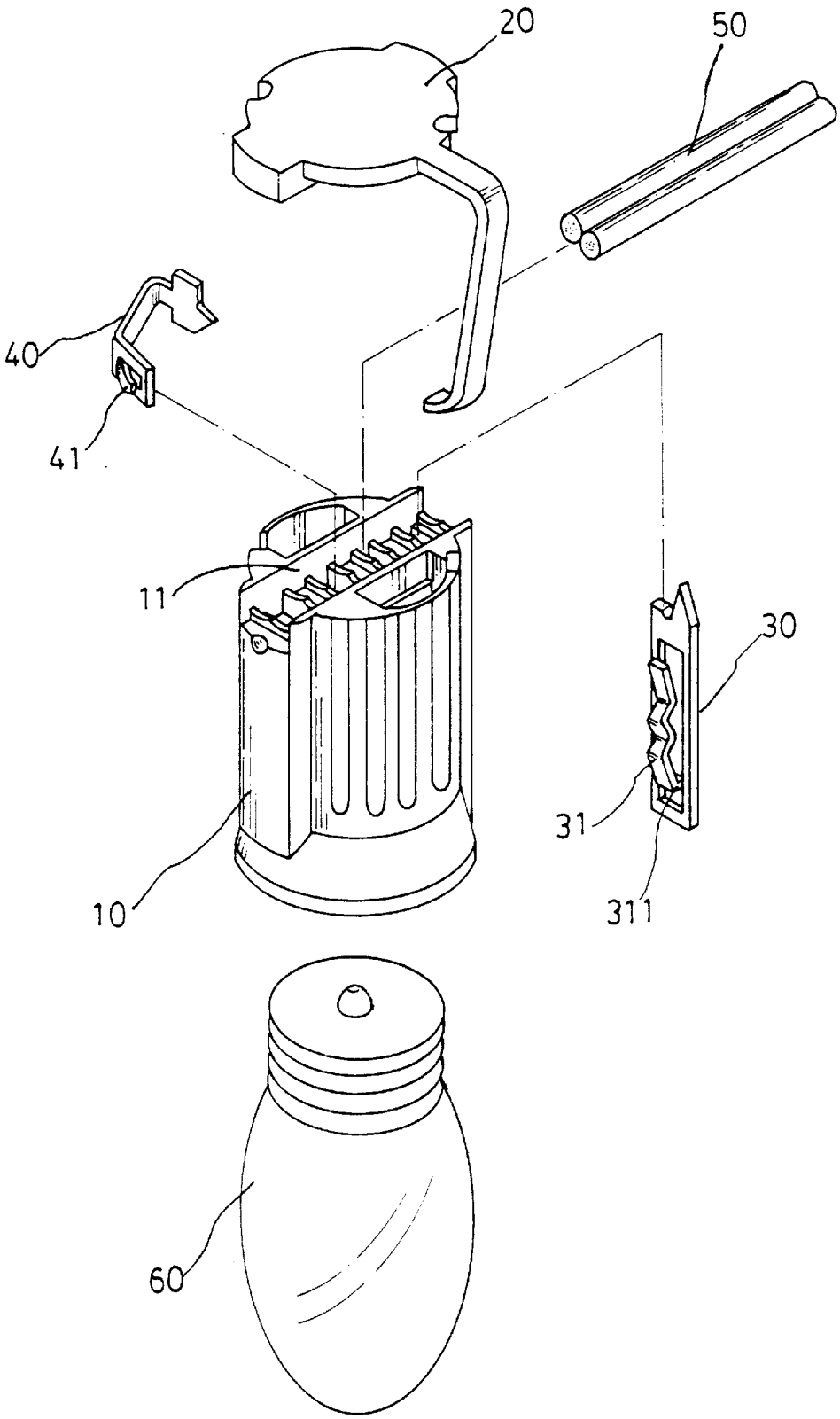
FIG. 1 is an exploded perspective view showing a C-type lamp holder and a lamp according to the present invention.
Figure 2:
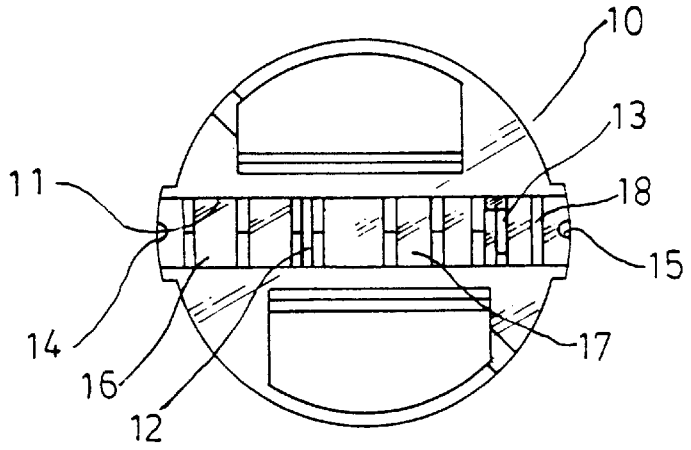
FIG. 2 is a bottom plan view of this present invention.
Figure 3:
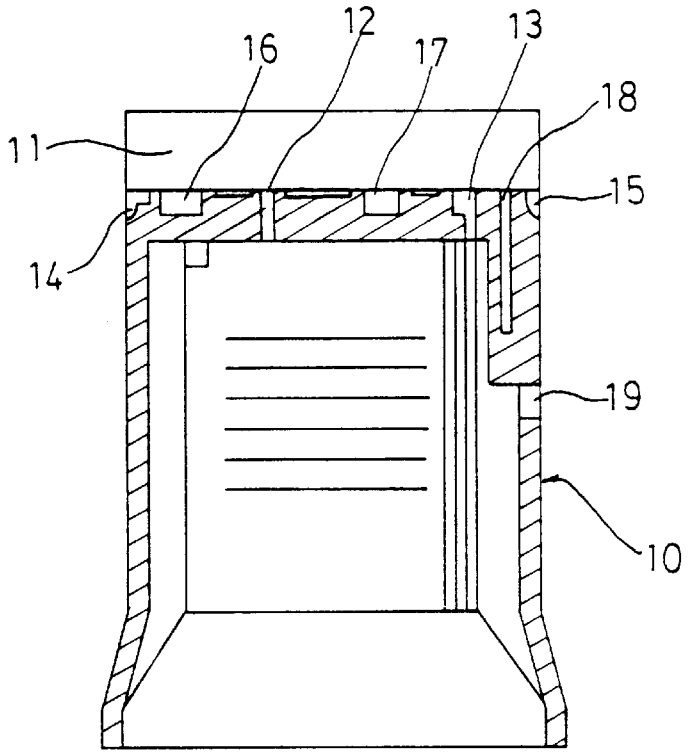
FIG. 3 is a cross sectional view showing the lamp holder of the present invention.
Figure 4:
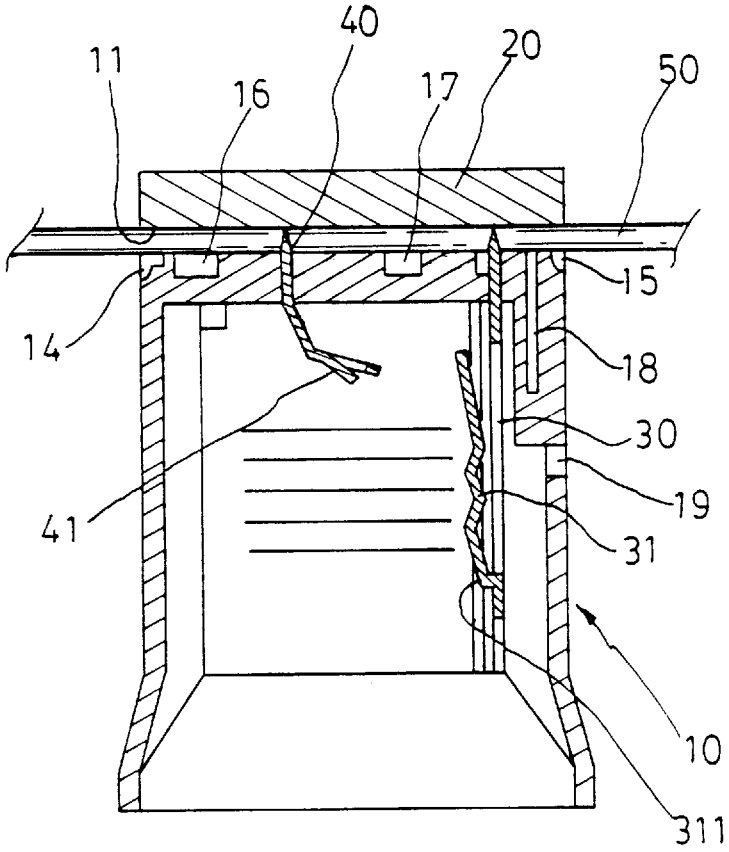
FIG. 4 is a cross sectional view of FIG. 3 when engaging with electrical wires and conductive plates.

Please refer to FIGS. 1 to 3, the present invention mainly includes a lamp holder (10), a cap (20), a side conductive plate (30), and a central conductive plate (40). A receiver (11) on the lamp holder (10) is provided for receiving electrical wires (50). A middle hole (12) is formed for engaging with the central plate (40), and a side hole (13) is formed for engaging with the side plate (30). A pair of grooves (14), (15) are formed at two sides of the receiver (11) on the holder (10). A water trough (16) is provided in the receiver (10) between the groove (14) and the middle hole (12), and another water trough (17) is provided between the middle hole (12) and the side hole (13). There is a collecting slot (18) provided between the side hole (13) and the side groove (15). A draining hole (19) is formed on a side of the holder (10) near to the side plate (30).

Figure 5:
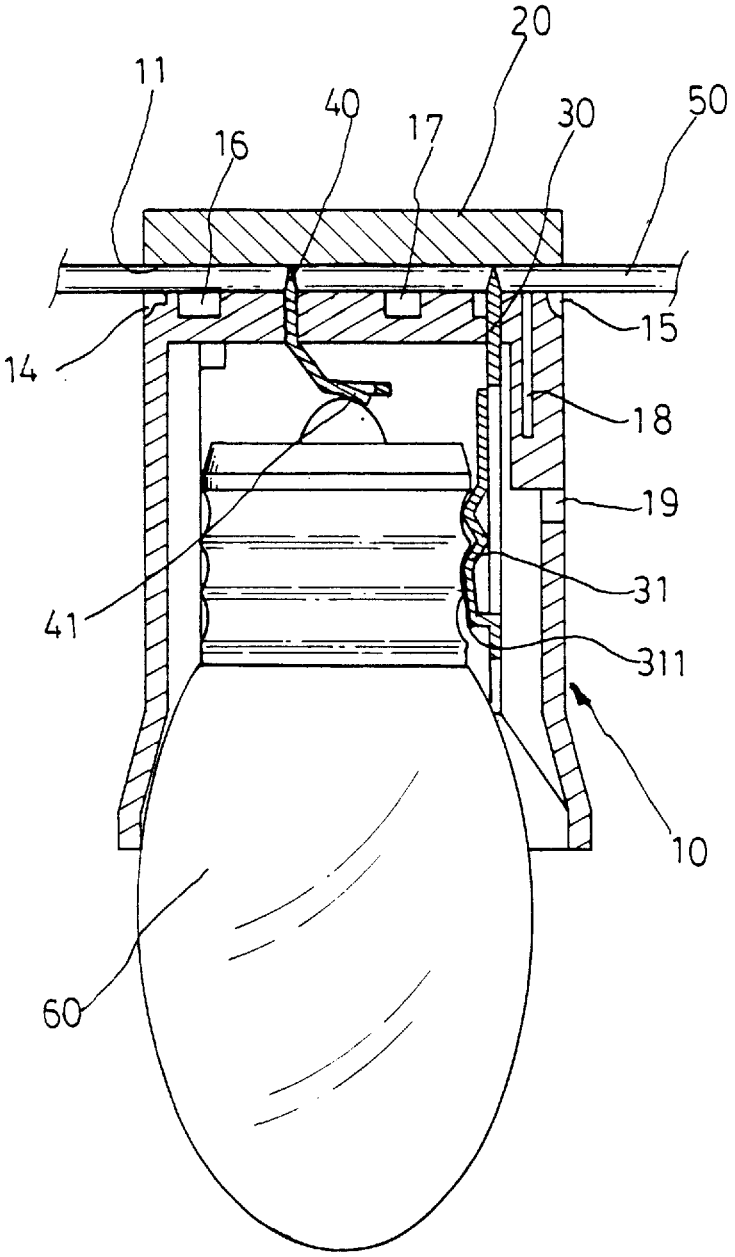
FIG. 5 is a cross sectional view of FIG. 4 when connecting with the lamp.

Referring to FIGS. 1 and 5, the central plate (40) has an inclined keen end for engaging within the hole (12) of the holder (10) and another elastic end with a elastic tongue (41) for contacting an end of the lamp (60). The side plate (30) has an inclined keen end for engaging within the hole (13) and an elastic plate (31) with a zigzag surface (311). The electrical wires (50) are connected within the receiver (11) by the cap (20) mounted over the lamp holder (10), and the two conductive plates (30), (40) are pricking in each of the two electrical wires of different electrical poles. As shown in FIG. 5, the contacting interfaces between the wires (50) and the holder (10) are moved inward from periphery of the holder (10) because of the two grooves (14), (15). These interfaces are unable of being touched by people and it prevents from risk if there is an electrical leakage. The water troughs (16), (17) and the collecting slot (18) are provided, that can separate the contact surface between the electrical wires and the receiver (11) of the lamp holder (10). If there are rain and moisture leaking in though the contact surface, the water will be received in the troughs or the slot and the two conductive plate (30), (40) will be kept separating from each other to prevent from the shortage of circuit.

As in FIG. 5, it can be seem that the connecting between the lamp holder (10) and the lamp (60) will be promised since the side plate (30) has the elastic zigzag contact surface (311) and the central plate (40) has the elastic tongue (41), that enforces the connection and contacting therebetween.

In conclusion, the present invention provides an obvious advantage, that includes the troughs and slot to separate from the contact surface between the electrical wires and the receiver of the lamp holder and the conductive plates. And the troughs and the slot are capable of receiving the leaking rain or moisture to prevent from a shortage of circuit and to overcome the defect of a known structure. Thus, the present invention should be allowed for patent.

I claim:

1. An improved C-type lamp holder including a lamp holder with an upper receiver for receiving a pair of electrical wires by connecting with a cap and for engaging with a central conductive plate and a side conductive plate in related holes formed in the receiver, and characterized in that:

a pair of side grooves being formed at two sides of the receiver and two water trough being formed in the receiver, one of which is between one side groove and the central plate and the other is between the central plate and the other conductive plate, while the slot being formed between the rear plate and the other side groove;

the contact surface between the wires and the receiver being separated by the troughs and the slot.

2. The improved C-type lamp holder as claimed in claim 1, wherein the central conductive plate being provided with a bottom elastic tongue and the side conductive plate being provided with an elastic plate having a zigzag surface, both of which are provided for elastic contacting with the lamp effectively.

* * * * *